US011293722B2

(12) United States Patent
Engelstein et al.

(10) Patent No.: US 11,293,722 B2
(45) Date of Patent: Apr. 5, 2022

(54) SMART SAFETY CONTRAPTION AND METHODS RELATED THERETO FOR USE WITH A FIREARM

(71) Applicants: Tal Engelstein, Ramat Gan (IL); Amir Bilu, Herzliya (IL)

(72) Inventors: Tal Engelstein, Ramat Gan (IL); Amir Bilu, Herzliya (IL)

( * ) Notice: Subject to any disclaimer, the term of this patent is extended or adjusted under 35 U.S.C. 154(b) by 316 days.

(21) Appl. No.: 16/209,438

(22) Filed: Dec. 4, 2018

(65) Prior Publication Data

US 2019/0170482 A1 Jun. 6, 2019

(30) Foreign Application Priority Data

Dec. 5, 2017 (IL) ..... 256122

(51) Int. Cl.
*F41G 3/26* (2006.01)
*F41A 33/00* (2006.01)
*F41A 17/44* (2006.01)

(52) U.S. Cl.
CPC ..... *F41G 3/2605* (2013.01); *F41A 33/00* (2013.01); *F41A 17/44* (2013.01)

(58) Field of Classification Search
CPC ..... F41G 3/26; F41G 3/2666; F41G 3/2605; F41A 33/00; F41A 33/02; F41A 33/04; F41A 33/06; F41A 17/44
See application file for complete search history.

(56) References Cited

U.S. PATENT DOCUMENTS

| | | | | |
|---|---|---|---|---|
| 6,579,098 | B2 | 6/2003 | Shechter | |
| 9,140,509 | B2 | 9/2015 | Sullivan et al. | |
| 9,504,907 | B2 | 11/2016 | Carter | |
| 9,759,530 | B2 | 9/2017 | Miller | |
| 9,766,043 | B2 | 9/2017 | Uhr | |
| 2007/0190495 | A1 | 8/2007 | Kendir et al. | |
| 2008/0066362 | A1 | 3/2008 | Fidlow | |
| 2008/0233543 | A1* | 9/2008 | Guissin | F41G 3/2605 434/19 |
| 2016/0231087 | A1 | 8/2016 | Dvorkin | |
| 2016/0245620 | A1 | 8/2016 | Tello | |
| 2016/0252326 | A1 | 9/2016 | Jones et al. | |
| 2016/0373700 | A1 | 12/2016 | Sandoval | |

* cited by examiner

*Primary Examiner* — Timothy A Musselman
(74) *Attorney, Agent, or Firm* — M&B IP Analysts, LLC

(57) ABSTRACT

A smart safety contraption for use with a firearm. The smart safety contraption includes of a tubular body adapted to fit into a barrel of the firearm. The tubular body having a front end having a first diameter and a back end having a second diameter. The first diameter is smaller than the second diameter. At least part of the front end is positioned within the barrel directed to a muzzle of the firearm. The smart safety contraption further comprises an image capturing device installed within the front end and directed to objects located in front of the barrel. The smart safety contraption further includes a control unit adapted to cause an image to be captured by the image capturing device upon receiving an indication corresponding to, e.g. a motion of the trigger. The image may include a graphic element designed to indicate a virtual point of impact.

9 Claims, 6 Drawing Sheets

SMART SAFETY CONTRAPTION AND METHODS RELATED THERETO FOR USE WITH A FIREARM

CROSS-REFERENCE TO RELATED APPLICATIONS

This application claims priority under 35 U.S.C. 119 to Israel Application No. 256122, filed Dec. 5, 2017, now pending.

TECHNICAL FIELD

The present disclosure generally relates to dry-fire practice systems, and more specifically to a smart safety contraption mounted within a barrel of a firearm adapted to monitor user's performances during a dry-fire practice.

BACKGROUND

Dry-fire practice involves manipulating and using the weapon without loading the weapon with live ammunition. Typically, dry-fire practices are performed to simulate actual firing of the firearm when there is no suitable place to practice with live ammunition. As such dry-fire practices save time and money as there is no need to use expensive ammunition.

Dry-fire practice are a versatile and safe way to practice with firearms and improve shooting skills. There are several systems by which dry-fire practice can be performed. However, one major disadvantage of such systems is that these systems require to change the properties of the firearm (e.g., weight and shape). As a result, the practicing using such systems is no realistic.

Several systems exist today that allow users to capture motion and analyze the motion. These systems typically include video-based, wearable sensor-based or wireless sensor-based approaches. In the case of video capture, the user should have a video camera equipment setup in the location where the user wishes to use the equipment. In the case of wearable sensors, the sensors provide positional data that must be analyzed by a professional or otherwise skilled analyst to provide valuable feedback to the user. Furthermore, the wearable sensors are unable to be located in a precisely reproducible position with respect to the body of the user, thus introducing variability in the measured positions. These systems have limitations due to available equipment, performance constraints, and the need for human interpretation of gathered data.

Another known system, disclosed in the related art includes, an illuminator for emitting, upon receiving a command from a controller, a beam of visible or invisible illumination from the barrel of the firearm, the beam being parallel to its central axis. The illuminator provides indication of a virtual point of impact, however the indication is a light that terminates rapidly. Therefore, it is difficult to identify the virtual point of impact and to improve the user's shooting skills.

It would therefore be advantageous to provide a solution that would overcome the deficiencies noted above.

BRIEF DESCRIPTION OF THE DRAWINGS

The subject matter that is regarded as the disclosure is particularly pointed out and distinctly claimed in the claims at the conclusion of the specification. The foregoing and other objects, features and advantages of the disclosure will be apparent from the following detailed description taken in conjunction with the accompanying drawings.

DETAILED DESCRIPTION

Figure 1:
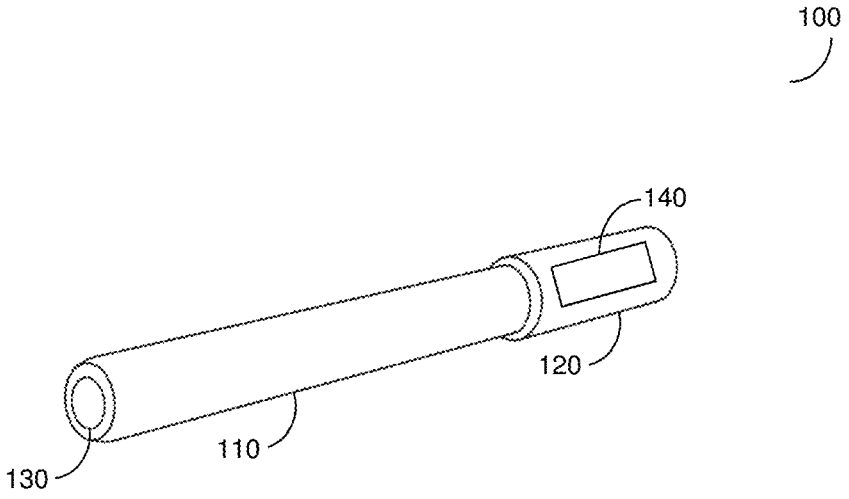
FIG. 1 is a front isometric view of a smart safety contraption for use with a firearm, according to an embodiment.

The embodiments disclosed by the disclosure are only examples of the many possible advantageous uses and implementations of the innovative teachings presented herein. In general, statements made in the specification of the present application do not necessarily limit any of the various claimed disclosures. Moreover, some statements may apply to some inventive features but not to others. In general, unless otherwise indicated, singular elements may be in plural and vice versa with no loss of generality. In the drawings, like numerals refer to like parts through several views.

By way of example to the disclosed embodiments, a smart safety contraption for use with a firearm is provided. The smart safety contraption includes a tubular body adapted to fit into a barrel of the firearm. The tubular body having a front end having a first diameter and a back end having a second diameter. The first diameter is smaller than the second diameter. At least part of the front end is positioned within the barrel directed to a muzzle of the firearm. The smart safety contraption further includes an image capturing device installed within the front end and directed to objects located in front of the barrel. The smart safety contraption further includes a control unit adapted to cause an image to be captured by the image capturing device upon receiving an indication corresponding to, e.g. a motion of the trigger. The image may include a graphic element designed to indicate a virtual point of impact.

FIG. 1 shows an example front isometric view of a smart safety contraption 100 for use with a firearm, according to an embodiment. The smart safety contraption 100 comprises a tubular body adapted to fit into a barrel of the firearm. The tubular body having a front end 110 having a first diameter and a back end 120 having a second diameter. The first diameter is smaller than the second diameter. At least part of the front end 100 is positioned within the barrel directed to a muzzle of the firearm. The muzzle is the tip of the barrel.

In an embodiment, at least part of the front end 110 protrudes from the muzzle. The reason that at least part of the front end 110 protrudes from the muzzle is to ensure that the firearm is safe for use and in order to have a better image capturing ability since the barrel does not block the visual field of an image capturing device that is further described herein below. The smart safety contraption 100 may be made of a rigid or flexible material and designed to be easily inserted and removed from the barrel of the firearm.

The smart safety contraption 100 further comprises an image capturing device 130 installed within the front end 110. The image capturing device 130 is directed to the muzzle and may protrude from the muzzle such that objects located in front of the barrel may be captured by the image capturing device 130. The image capturing device 130 may be for example a digital camera.

According to one embodiment, the smart safety contraption 100 comprises a power source (not shown) such as a battery, a rechargeable battery, and so on. According to another embodiment the smart safety contraption 100 comprises a port for charging the power source. According to another embodiment, the smart safety contraption 100 comprises a controller 140 that is further described in FIG. 2. The controller 140 may be embedded within the smart safety contraption 100 and powered by the power source.

The controller 140 may include a communication circuit (shown in FIG. 2) allowing establishment of wired and/or wireless communication link between the smart safety contraption 100 and an end-point device, such as a smartphone, a tablet, a personal computer, a wearable device, and so on. The smart safety contraption 100 may further comprise one or more sensors such as, a sound detection sensor, a motion detector, a proximity sensor, a temperature sensor, a touch detector, etc. configured to collect data associated with one or more operations of the firearm such as, a trigger break.

Figure 2:
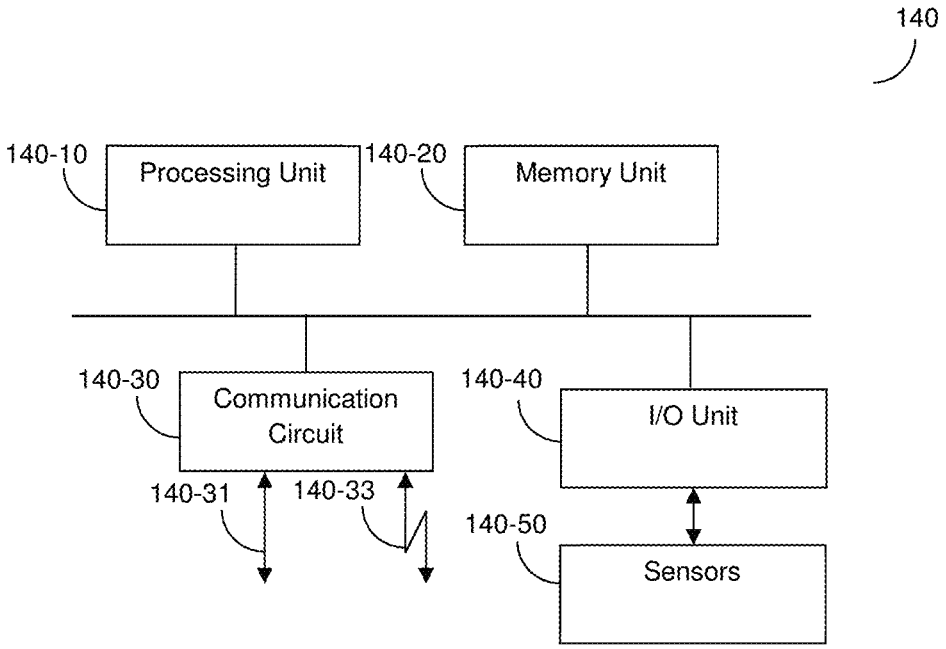
FIG. 2—is a schematic block diagram showing components of a controller of a smart safety contraption, according to an embodiment.

FIG. 2 shows an example schematic block diagram of the components of a controller 140 of a smart safety contraption 100, according to an embodiment. The controller 140 may be embedded within the smart safety contraption 100. The controller 140 comprises a processing unit 140-10 and a memory unit 140-20. The control unit 140 further comprises a communication circuit 140-30 and an input/output (I/O) unit 140-40 as further described herein below.

The memory 140-20 may contain therein instructions that when executed by the processor 140-10 cause the processor 140-10 to execute actions, such as, causing the image capturing device 130 to capture images, measuring time pointers at which a trigger of the firearm was pulled, and so on. Measuring time pointers at which an image was captured may be achieved using a timer, a clock, and so on, that is connected to and controlled by the processor 140-10.

According to another embodiment the processor 140-10 may be utilized for sending the one or more images captured by the image capturing device 130 to an end-point device such as, a smartphone. The memory unit 140-20 may store therein information corresponding to previous practice sessions made by a user. Thus, the processor 140-10 enables, for example, to determine whether the user's shooting skills have been improved by comparing current set of captured images to historical captured images, associated with previous dry-fire practice sessions. According to one embodiment, the processor 140-10 may be configured to determine whether the user's skill to aim to the center of mass of a human target has been improved, by comparing 20 different images of 20 trigger breaks captured right after the firearm was draw in front of 20 different human targets.

The communication circuit 140-30 is configured to perform wired 140-31 and/or wireless 140-33 communication with external components. Such external components may be for example, a controller mounted within one of the components of the firearm enabling collection of data such as a trigger break. According to another embodiment, the communication circuit 140-30 enables to communicate with a wired or wireless network, wired or wireless end-point devices, and so on.

The input/output (I/O) unit 140-40 may be utilized to control, for example, the sensors 140-50. A sensor 140-50 may be, for example, but not limited to, a camera, a microphone, a motion detector, a proximity sensor, a temperature sensor and a touch detector, configured to sense and identify data. The data may be associated with, for example, one or more operations of the firearm such as identification of a presence of a finger on the trigger, identification of a trigger break, identification of a movement of the firearm, etc.

The sensors 140-50 may be connected directly to the communication circuit 140-30. Alternatively, the one or more sensors 140-50 may be communicatively connected to the processor 140-10 that allows collection of the data from the sensors 140-50.

Figure 3A:
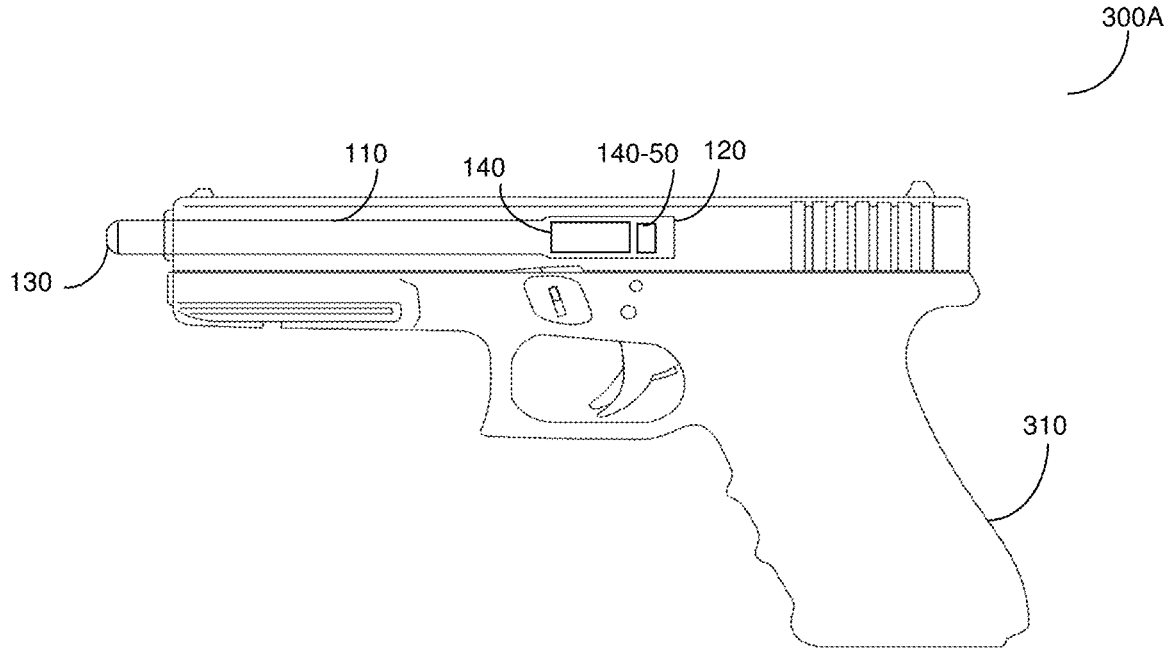
FIG. 3A—is a side view of a smart safety contraption embedded within a firearm, according to an embodiment.

FIG. 3A shows an example side view of a smart safety contraption 100 embedded within a firearm 310, according to an embodiment. The firearm 310 may be for example Glock®, Sig Sauer®, M-16, AK-47, etc. It should be noted that the smart safety contraption 100 may be implemented in different diameters in order to fit into a variety of barrels of different firearms, since the barrels of different firearms may have different diameters, such as, 9 millimeters, 5.56, etc.

According to one embodiment, at least one of the plurality of sensors 140-50 such as a touch detector, a motion detector, a microphone may be configured to sense a predefined motion, sound, touch, and so on, that indicates that the trigger of the firearm was pulled, or about to be pulled. Afterwards, the processor 140-10 may cause the image capturing device 130 to start capturing images. The processor 140-10 causes the image capturing device 130 to capture images that are correlated to time pointers at which the trigger was pulled. As further described herein above and below in FIG. 6, the images include a graphic element, such as a cross, a point, etc. designed to indicate a virtual point of impact.

That is to say, each image includes for example, a cross on it that is indicative of a virtual point of impact. The virtual point of impact emulates the point at which a bullet would strike if the shooting were real, i.e. using real ammunition. The images may be stored in a memory unit, cloud database, and/or displayed on an end-point device, e.g. a smartphone.

Figure 6:
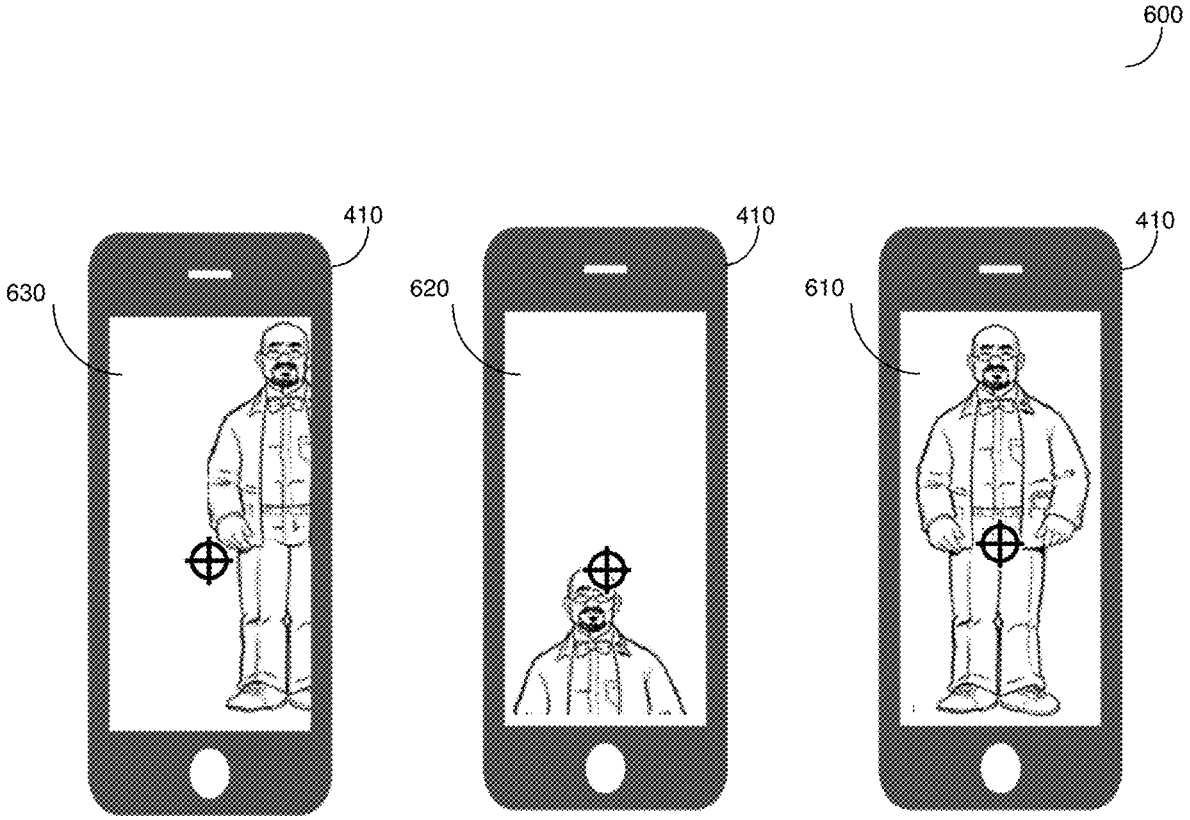
FIG. 6 is a diagram showing captured images, including a graphic element therein, displayed on a display unit of an end-point device according to an embodiment.

When the captured images, having shown therein the graphic elements, are displayed on an end-point device, a user may be able to see the strikes' position since the image capturing is correlated with the trigger breaks and the graphic element is associated with the barrel direction as further described in FIG. 6. According to another embodiment, the processor 140-10 may cause the image capturing device 130 to start capturing images prior to a trigger break. Thus, the end-point device (shown in FIG. 4) may display captured images that shows the barrel's motion prior to the trigger break, and therefore the user may see the position of the sight, i.e. the graphic element, with respect of the target 1 second, 0.5 second, 0.2 second, etc. before the trigger was pulled.

Figure 3B:
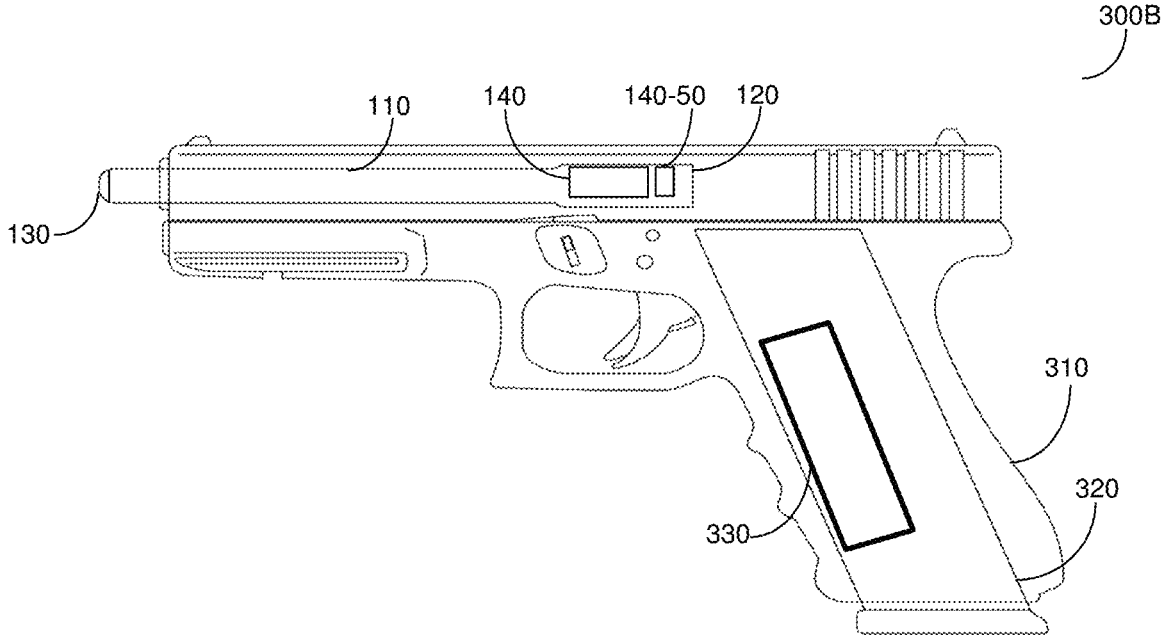
FIG. 3B is a side view of a smart safety contraption embedded within a firearm having a smart dry-fire magazine according to an embodiment.

FIG. 3B shows an example side view of a smart safety contraption 100 embedded within a firearm 310 having a smart dry-fire magazine 320 adapted to collect data and communicate with the smart safety contraption 100, according to an embodiment. As further described in FIG. 2, the smart safety contraption 100 may be configured to perform wired 140-31 and/or wireless 140-33 communication with external components. Such external components may be for example, a smart dry-fire magazine 320 mounted within the firearm enabling collection of data such as a trigger break.

The smart dry-fire magazine 320 may comprise a plurality of sensors (shown in FIG. 2) enabling collection of data that indicates whether, for example, the trigger was pulled. The smart dry-fire magazine 320 comprises at least a controller 330 allowing to collect the data and communicate with the smart safety contraption 100 through the communication unit 140-30 of the smart safety contraption 100.

For example, after the controller 330 identifies that the trigger was pulled, the controller 330 sends a command to the communication circuit 140-30 of the smart safety contraption 100, to capture at least one image using the image capturing device 130. According to the same example, the command is received at the communication circuit 140-30, delivered to the processor 140-10 and executed by the image capturing device 130.

Figure 4:
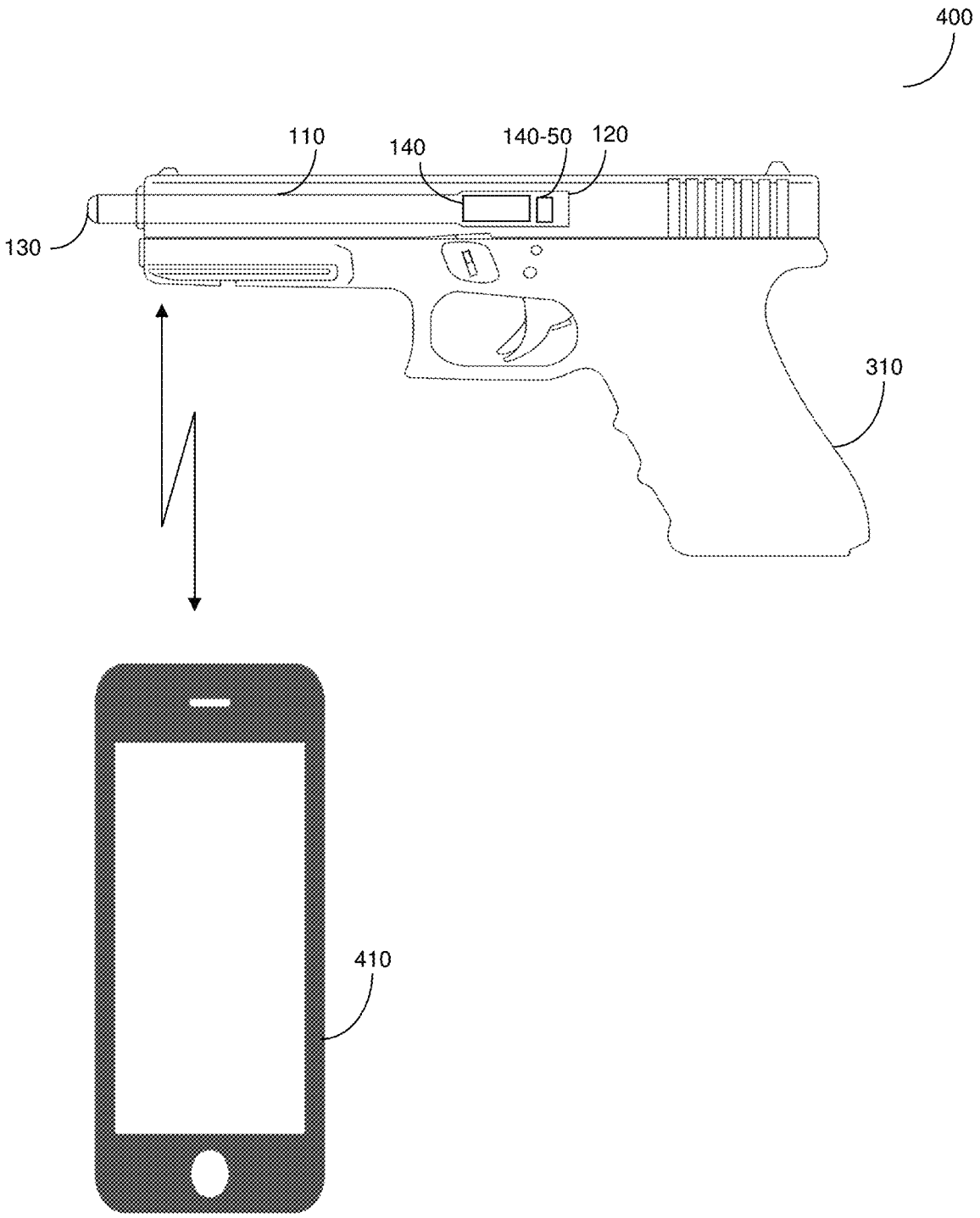
FIG. 4 is a schematic diagram of a smart safety contraption for use with a firearm adapted to communicate with an end-point device according to an embodiment.

FIG. 4 is an example schematic diagram of a smart safety contraption 100 for use with a firearm adapted to communicate with an end-point device according to an embodiment. As further described herein above, the smart safety contraption 100 comprises a controller 140. The controller 140 includes a communication circuit (shown in FIG. 2) allowing establishment of, for example, a wireless communication link between the smart safety contraption 100, i.e. the controller 140, and an end-point device (EPD) such as the EPD 410. The EPD 410 may be for example, a smartphone, tablet, personal computer (PC), laptop, wearable device, etc. According to one embodiment the processing unit (shown in FIG. 2) may be utilized for storing and/or sending the captured images including therein the graphic elements, to the EPD 410. The EPD 410 be configured to display the captured images, having therein graphic elements, on a display unit of the EPD 410.

Figure 5:
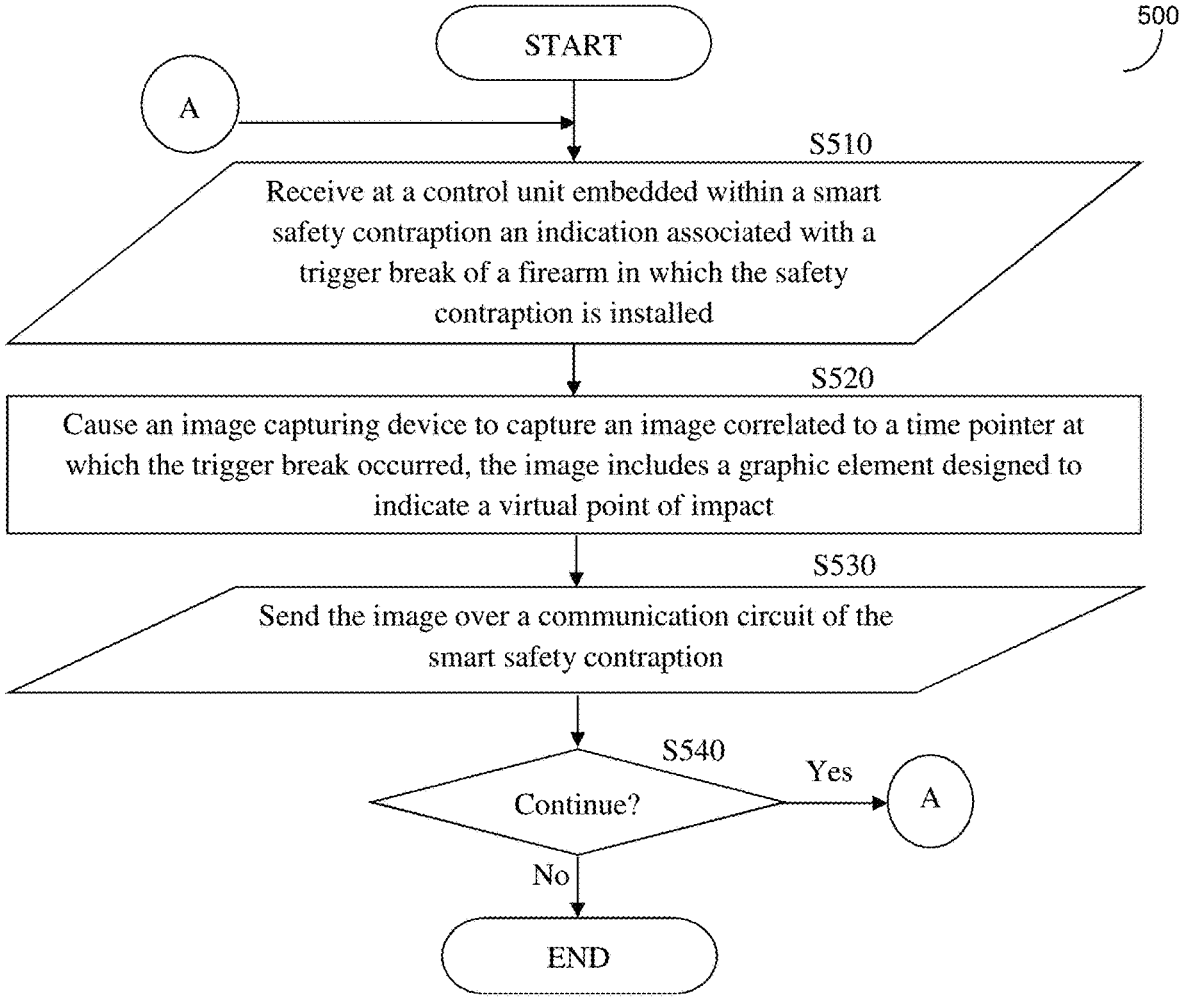
FIG. 5 is a method for using a smart safety contraption according to an embodiment.

FIG. 5 depicts an example flowchart 500 illustrating a method for using a smart safety contraption according to an embodiment. At S510, an indication associate with a trigger break of a firearm is received. The indication may be received by a controller 140 of the smart safety contraption 100. The smart safety contraption 100 is positioned within the barrel of the firearm.

At S520, an image correlated to a time pointer at which the trigger break occurred is captured, upon receiving the indication. The image includes a graphic element designed to indicate a virtual point of impact as further described herein above.

At S530, the captured image is sent using, for example, a communication circuit 140-30 of the smart safety contraption 100. One or more captured images may be sent to the EPD 410 and/or to multiple EPDs 410. S540 is an optional step, it is checked whether to continue the operation and if so, execution continues with S510; otherwise, execution terminates.

FIG. 6 is an example diagram showing captured images, including a graphic element therein, displayed on a display unit of an end-point device according to an embodiment. As further described herein above, the graphic element may be a cross, point, a combination thereof, and so on configured to mark the virtual point of impact in images displayed on the end-point device 410.

In an embodiment, image 610 represents the first time at which the trigger break occurred in front of a human target. Image 610 shows that the trigger was pulled while the firearm, the barrel, was pointed to the center of mass of the human target and may be occurred on 18:34:21.8. The second image 620 represents the second time the trigger was pulled on the same session. At image 620, the virtual point of impact was above the target and occurred on 18:34:22.6. Image 630 shows that the trigger was pulled while the firearm was pointed to the hand of the human target. Image 630 was captured on 18:34:23.3.

In an embodiment, the graphic element is static such that the target may be located in different positions in different images captured by the image capturing device 130, but the graphic element, e.g. the cross and the circle, is located at the same position with respect of the image boundaries.

The various embodiments disclosed herein may be implemented as hardware, firmware, software, or any combination thereof. Moreover, the software is preferably implemented as an application program tangibly embodied on a program storage unit or computer readable medium. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such computer or processor is explicitly shown. In addition, various other peripheral units may be connected to the computer platform such as an additional data storage unit and a printing unit.

All examples and conditional language recited herein are intended for pedagogical purposes to aid the reader in understanding the principles of the disclosure and the concepts contributed by the inventor to furthering the art, and are to be construed as being without limitation to such specifically recited examples and conditions. Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

A person skilled-in-the-art will readily note that other embodiments of the disclosure may be achieved without departing from the scope of the disclosed disclosure. All such embodiments are included herein. The scope of the disclosure should be limited solely by the claims thereto.

What is claimed is:

1. A smart safety contraption for use with a firearm, comprising:

a tubular body adapted to fit into a barrel of the firearm, the tubular body having a front end having a first diameter and a back end having a second diameter, wherein the first diameter is smaller than the second diameter, and wherein at least part of the front end is positioned within the barrel directed to a muzzle of the firearm; and, an image capturing device installed within the front end of the tubular body such that the image capturing device is positioned outside the barrel.

2. The smart safety contraption of claim 1, further comprising:

a power source.

3. The smart safety contraption of claim 2, further comprising:

a controller embedded within the smart safety contraption and powered by the power source.

4. The smart safety contraption of claim 3, wherein the controller is further configured to cause the image capturing device to capture images when the motion of the trigger break is detected.

5. The smart safety contraption of claim 4, wherein each image includes a graphic element designed to indicate a virtual point of impact.

6. The smart safety contraption of claim 1, further comprising:

a communication circuit configured to interface over a communication channel with at least one end-point device.

7. The smart safety contraption of claim 6, wherein the communication circuit is configured to receive a command from at least one external component for capturing at least one image using the image capture device.

8. The smart safety contraption of claim 1, further comprising:

at least one sensor for collecting data related to the at least the operation of the firearm.

9. The smart safety contraption of claim 8, wherein the at least one sensor is configured to detect a motion of a trigger break of the firearm.

* * * * *